US005462088A

United States Patent [19]

Poux et al.

[11] Patent Number: 5,462,088

[45] Date of Patent: Oct. 31, 1995

[54] GAS TURBINE EXHAUST DIFFUSER

[75] Inventors: Jacques Poux, Grenoble; Liberto Gandia, Blevilliers; Frédéric Rouget, Valdoie, all of France

[73] Assignee: Societe Anonyme Dite: European Gas Turbines SA, Paris, France

[21] Appl. No.: 140,394

[22] Filed: Oct. 25, 1993

[30] Foreign Application Priority Data

Oct. 26, 1992 [FR] France ..... 92 12724

[51] Int. Cl.[6] ..... F15D 1/08

[52] U.S. Cl. ..... 138/39; 138/42; 138/44; 244/136

[58] Field of Search ..... 138/37, 39, 42, 138/44; 244/136; 239/498, 502, 265.13, 265.19, 127.1, 265.35; 60/694

[56] References Cited

U.S. PATENT DOCUMENTS

| | | | |
|---|---|---|---|
| 1,940,790 | 12/1933 | Diehl . | |
| 3,095,697 | 7/1963 | Reinhart | 239/265.13 |
| 3,134,655 | 5/1964 | Boucher | 138/37 |
| 3,191,380 | 6/1965 | Gratzer | 138/37 |
| 3,436,020 | 4/1969 | Duthion et al. | 239/265.13 |
| 3,533,561 | 10/1970 | Henderson | 239/498 |
| 3,613,996 | 10/1971 | Tanner | 239/265.13 |
| 3,909,156 | 9/1975 | Stahl . | |
| 4,497,345 | 2/1985 | Lees | 138/39 |
| 4,619,138 | 10/1986 | Ohnhaus | 138/37 |
| 4,753,780 | 6/1988 | Bowen | 239/500 |
| 5,099,879 | 3/1992 | Baird | 138/39 |

FOREIGN PATENT DOCUMENTS

| | | | |
|---|---|---|---|
| 0000036 | 1/1967 | United Kingdom | 239/502 |

*Primary Examiner*—David Scherbel
*Assistant Examiner*—James F. Hook
*Attorney, Agent, or Firm*—Sughrue, Mion, Zinn, Macpeak & Seas; Richard C. Turner; Steven M. Gruskin

[57] ABSTRACT

The present invention relates to an exhaust diffuser for a gas turbine, the diffuser being designed to be inserted downstream from a last expansion stage constituted by an outlet duct of circular cross-section containing a central bulb. The diffuser includes a flared transition duct having an inlet end of circular cross-section identical to the cross-section of the outlet duct of the last stage, an outlet end of square cross-section, and four fixed fins disposed inside the ducts close to respective corners of the square cross-section for directing the exhaust gases toward the corners of the square cross-section.

10 Claims, 2 Drawing Sheets

GAS TURBINE EXHAUST DIFFUSER

The present invention relates to a gas turbine exhaust diffuser.

BACKGROUND OF THE INVENTION

More precisely, the invention concerns an exhaust diffuser for a gas turbine, the diffuser being designed to be inserted downstream from a last expansion stage constituted by an outlet duct of circular cross-section containing a central bulb.

The gases from gas turbines leave the last expansion stage at very high speeds. It is necessary to reduce such speeds considerably before discharging the gases into the atmosphere, so as to ensure that the exhaust equipment remains reliable by reducing the stresses due to the flow, so as to enhance the performance levels of the turbine by limiting the head loss of the flow, and so as to be capable of providing appropriate treatment for the noise emitted by the exhaust of the turbine.

It is therefore essential to master the problem of diffusing the flow of the exhaust gases if the overall performance levels of a gas turbine are to be mastered technically.

The dimensions of the ducts and of the diffusing members also have a non-negligible economic impact, especially when the sizes of turbines are tending to increase, as is now the case, and the compactness of the exhaust ducts is another essential parameter in making a high-performance gas exhaust system.

Gas turbine exhaust gases are exhausted via a duct of circular cross-section, and the stream of air discharged thereby is to a certain extent annular in cross-section given the central bulb. The end of the central bulb and therefore the annular flow cross-section is the most critical region of the diffusion. The limits and the sources of instability of the diffusion are to be found in that region.

Generally speaking, the outlet of the duct of circular cross-section must be connected to a duct of square cross-section so as to obtain a duct that can be used for installing silencer devices, and also to obtain overall compactness of the ducts. This transition limits the possibility of diffusing the gases correctly, in stable manner and with homogeneous speed profiles.

OBJECT AND SUMMARY OF THE INVENTION

The present invention provides a diffuser designed to be interposed between the outlet of the duct of circular cross-section and the inlet of a duct of square cross-section, e.g. of a silencer device, which diffuser solves any problems of instability in the flow.

To this end, according to the invention, the diffuser comprises:

a flared transition duct having an inlet end of circular cross-section identical to the cross-section of the outlet duct of the last stage, and an outlet end of square cross-section; and four fixed fins disposed inside said ducts, close to respective corners of the square cross-section, and directing the exhaust gases towards the corners of the square cross-section.

Preferably, each fin is constituted by a metal sheet in the shape of a quadrilateral having perpendicular diagonals and folded along its long diagonal so as to have a V-shaped cross-section, the opening of the V facing the inside walls of said ducts.

Advantageously, the folded long diagonal is disposed sloping, with its upstream end being in the vicinity of the end of the bulb and separated from the axis of symmetry of the transition duct by a distance that is slightly greater than the radius of the bulb, and its downstream end being disposed in the vicinity of a corner of the square cross-section.

BRIEF DESCRIPTION OF THE DRAWINGS

The functions and advantages of these characteristics will appear on reading the following description of a preferred embodiment of the invention given with reference to the accompanying drawings, in which.

MORE DETAILED DESCRIPTION

Figure 1:
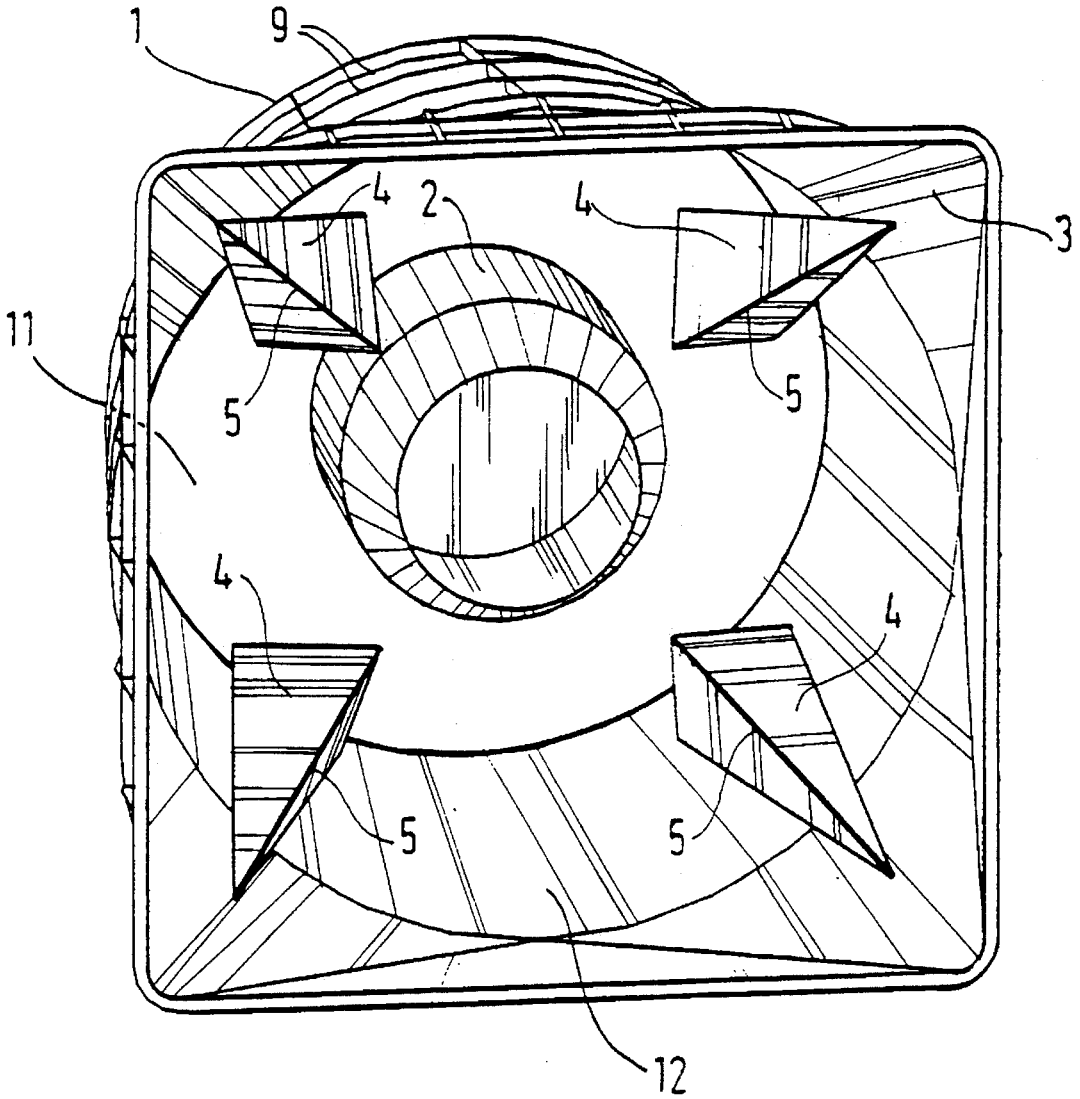
FIG. 1 is a perspective view of the diffuser of the invention mounted downstream from a last gas turbine stage, as seen from downstream.

The exhaust diffuser for a gas turbine is inserted downstream from a last expansion stage constituted by a duct 1 of circular cross-section containing a central cylindrical bulb 2 whose cross-section tapers at one end.

The diffuser comprises:

a flared transition duct 3 having an inlet end of circular cross-section identical to the cross-section of the duct 1 of the last stage, and an outlet end of square cross-section; and four fixed fins 4 disposed inside said ducts 1, 3, close to respective corners of the square cross-section, and directing the exhaust gases towards the corners of the square cross-section.

Figure 2:
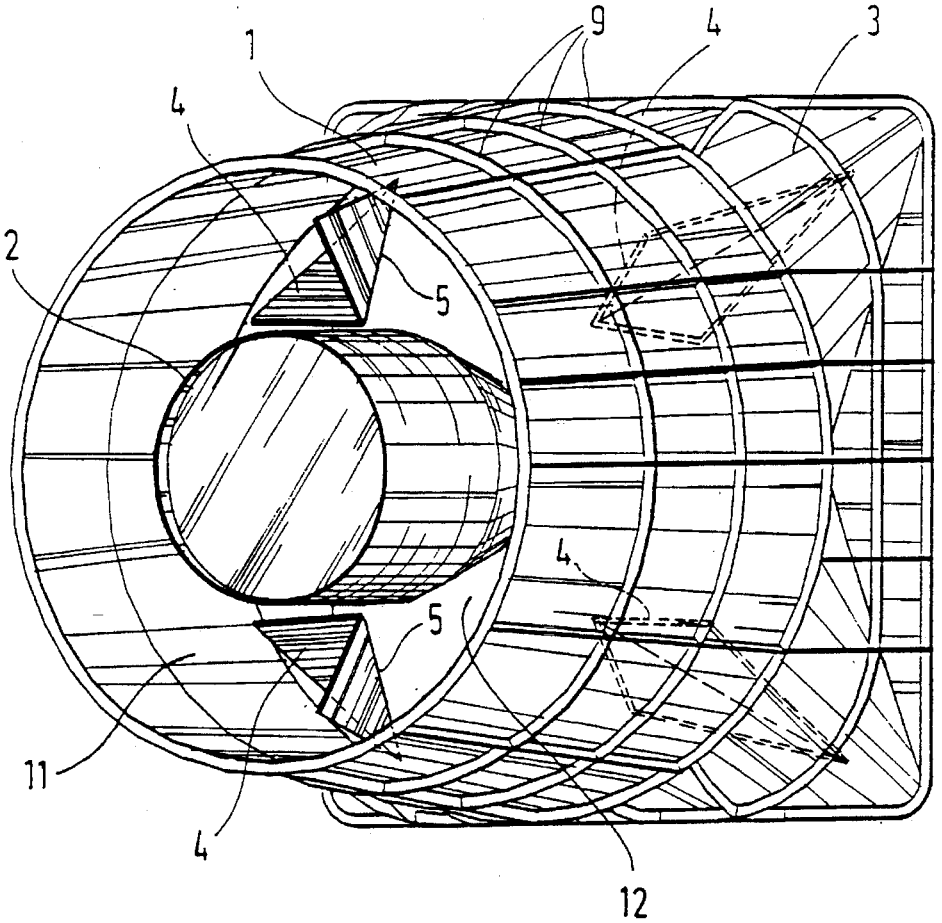
FIG. 2 is a perspective view of the diffuser of the invention mounted downstream from a last gas turbine stage, as seen from upstream.

The ducts 1, 3 are reinforced in conventional manner by means of stiffeners 9 welded to the outside walls thereof. The fins 4 are preferably fixed via struts (not shown in FIGS. 1 and 2 and referenced 10 in FIG. 3) which are welded to the respective fins 4 and to the inside wall of the transition duct 3.

Each fin 4 is constituted by a metal sheet in the shape of a quadrilateral having perpendicular diagonals and folded along its long diagonal 5 so as to have a V-shaped cross-section, the opening of the V facing the inside walls of said ducts 1, 3. The folded long diagonal 5 is disposed sloping, with its upstream end 6 being in the vicinity of the end of the bulb 2 and separated from the axis of symmetry 8 of the transition duct 3 by a distance that is slightly greater than the radius of the bulb 2, and its downstream end 7 being disposed in the vicinity of a corner of the square cross-section.

Figure 3:
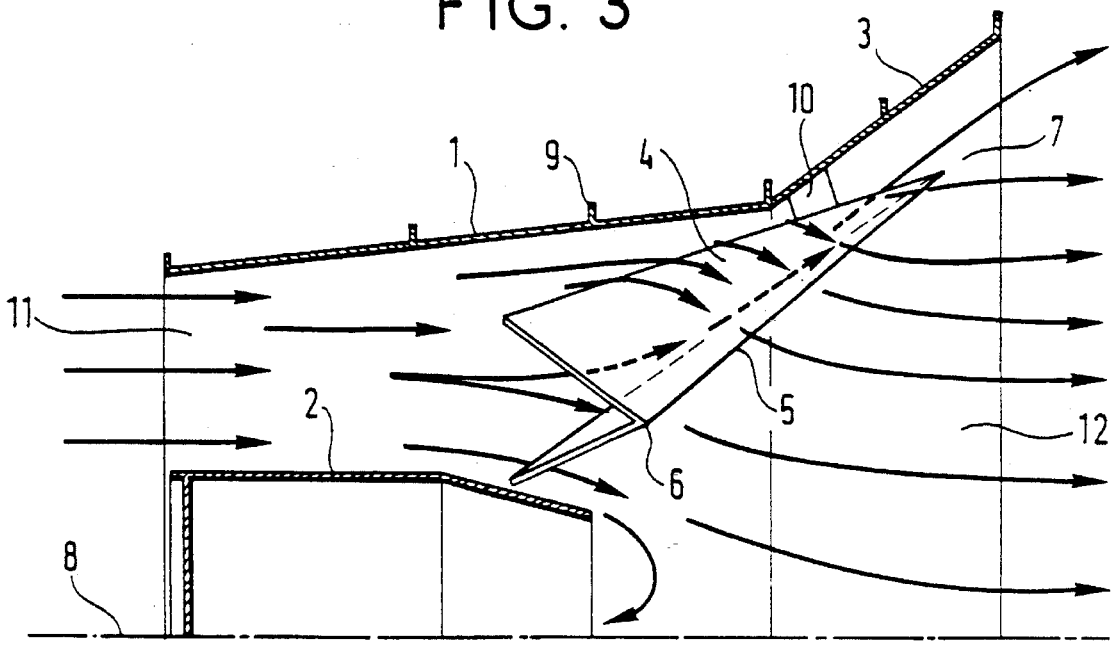
FIG. 3 is a longitudinal section through the diffuser of the invention mounted on a last gas turbine stage, showing the flow of the gases.

The resulting diffusion of the gases is shown in FIG. 3. The downstream flow 11 has an annular cross-section around the bulb 2. At the end of the bulb 2, instead of entering a particularly unstable region, the downstream flow is guided by the fins 4 which diffuse it almost perfectly over the entire area 12 of the square cross-section of the transition duct 3, by directing it, in particular, towards the corners thereof.

The use of a duct having a square cross-section that is tangential to the duct of circular cross-section 1 makes it possible to avoid accentuating the diffusion along the vertical and the horizontal axes.

By means of the fins 4, a portion of high-energy flow is taken from the end of the bulb 2 where it is stable and is directed towards the corners of maximum diffusion. The fins 4 both divert the gases progressively over the sides of the square cross-section and inject a portion thereof into the corners of the square cross-section, via the transition duct 3.

The design of the fins 4 makes it possible to stabilize the slowed-down fluid a few meters downstream. Stability is obtained for a relatively wide range of angles of incidence of flow over the fins, of about plus or minus 30°.

Moreover, at the most frequent operating points and at the design points of installations having gas turbines, the diffuser makes it possible to obtain very good distribution of flow speeds a few meters downstream, the ratio of the mean speed to the ideal speed being about plus or minus 30%.

Finally, the diffuser generates little or no head loss linked to the performance levels of the gas turbine, and makes it possible, with a minimum amount of space, to obtain a performance gain that is considerably greater than said head loss.

We claim:

1. A diffuser for diffusing exhaust gases from a gas turbine, the diffuser being inserted downstream from a last expansion stage constituted by an outlet duct of circular cross-section containing a central bulb, said diffuser comprising:

a flared transition duct having an inlet end of circular cross-section identical to the circular cross-section of the outlet duct of the last expansion stage, and an outlet end of square cross-section; and fins supported on an inside wall of at least one of said ducts and spaced therefrom for directing a portion of the exhaust gases between said fins and the outlet duct and said transition duct towards the corners of the square cross-section.

2. A diffuser according to claim 1, wherein each fin comprises a metal sheet in the shape of a quadrilateral having perpendicular diagonals and folded along its long diagonal so as to have a V-shaped cross-section, the opening of the V facing the inside walls of said ducts.

3. A diffuser according to claim 2, wherein the folded long diagonal is inclined so that an upstream end of the diagonal is in the vicinity of the end of the bulb and separated from the axis of symmetry of the transition duct by a distance that is slightly greater than the radius of the bulb, and so that its downstream end is disposed in the vicinity of a corner of the square cross-section.

4. A diffuser according to claim 2, wherein the upstream end of each fin has the largest V-shaped cross-section, and wherein the downstream end is a tip end of the fin.

5. A diffuser as recited in claim 1, wherein the fixed fins are supported by struts welded to the fins and to the inside wall of said flared transition duct.

6. A diffuser for diffusing an exhaust gas stream from a gas turbine, said diffuser being located downstream from a last expansion stage of the gas turbine, the last expansion stage having a circular cross-section outlet duct with a central bulb, said diffuser comprising:

a divergent transition duct having a circular cross-section inlet identical in cross-section to the outlet duct of the last expansion stage and a square cross-section outlet having four corners, as well as a lateral transition wall connecting the circular cross-section inlet and the square cross-section outlet; and fins disposed within the exhaust gas stream, said fins being aerodynamically streamlined to provide a deflecting channel for deflecting the exhaust gases toward the four corners of the square cross-section outlet.

7. A diffuser as recited in claim 6, wherein said fins each comprise a metal sheet of quadrilateral shape with perpendicular diagonals and folded along the longest diagonal to form a V-shaped cross-section opening toward the transition wall.

8. A diffuser as recited in claim 7, wherein the upstream end of each fin has the largest V-shaped cross-section, and wherein the downstream end is a tip end of the fin.

9. A diffuser according to claim 8, wherein the upstream end of each fin is located in a vicinity of the end of the central bulb, and wherein the tip end of each fin is located in a vicinity of one of the four corners.

10. A diffuser as recited in claim 6, wherein said fins are supported by struts welded to said fins and to an inside wall of said transition duct.

* * * * *